US011069494B2

(12) United States Patent
Kubota et al.

(10) Patent No.: US 11,069,494 B2
(45) **Date of Patent: *Jul. 20, 2021**

(54) SWITCHGEAR

(71) Applicant: Mitsubishi Electric Corporation, Tokyo (JP)

(72) Inventors: Masato Kubota, Tokyo (JP); Daisuke Fujita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/643,979

(22) PCT Filed: Nov. 17, 2017

(86) PCT No.: PCT/JP2017/041509

§ 371 (c)(1),
(2) Date: Mar. 3, 2020

(87) PCT Pub. No.: WO2019/097681

PCT Pub. Date: May 23, 2019

(65) Prior Publication Data

US 2021/0066006 A1 Mar. 4, 2021

(51) Int. Cl.
*H01H 33/42* (2006.01)
*H01H 33/04* (2006.01)
(Continued)

(52) U.S. Cl.
CPC ..... *H01H 33/42* (2013.01); *H01H 33/045* (2013.01); *H01H 33/7084* (2013.01); *H01H 33/91* (2013.01); *H01H 33/40* (2013.01)

(58) Field of Classification Search
CPC ..... H01H 33/42; H01H 33/045; H01H 33/91; H01H 33/7084; H01H 33/40
See application file for complete search history.

(56) References Cited

U.S. PATENT DOCUMENTS 3,786,216 A * 1/1974 Beier ..... H01H 33/02 218/82
4,271,339 A * 6/1981 Meister ..... H01H 33/76 218/150

(Continued)

FOREIGN PATENT DOCUMENTS

EP 0348645 A2 1/1990
JP H0553094 U 7/1993

(Continued)

OTHER PUBLICATIONS

International Search Report (PCT/ISA/210), with translation, and Written Opinion (PCT/ISA/237) dated Feb. 6, 2018, by the Japan Patent Office as the International Searching Authority for International Application No. PCT/JP2017/041509.

(Continued)

*Primary Examiner* — Truc T Nguyen
(74) *Attorney, Agent, or Firm* — Buchanan Ingersoll & Rooney PC

(57) ABSTRACT

A switchgear includes a movable part capable of reciprocating movement, a movable contact coupled to the movable part, a member that biases the movable contact, a latch capable of switching between a first state in which movement of the movable contact is restricted and a second state in which movement is permitted, a part that accommodates the movable part and the movable contact therein, a fixed contact provided outside of the accommodating part, and a moving part that moves with the movable contact. The latch is switched to the second state when the movable contact has moved against the biasing force. The accommodating part contains a first region and a second region, which is on a side of the fixed contact with respect to the first region within a range of movement of the moving part. The first region has an inner diameter smaller than that of the second region.

7 Claims, 8 Drawing Sheets

(51) Int. Cl.
*H01H 33/70* (2006.01)
*H01H 33/91* (2006.01)
*H01H 33/40* (2006.01)

(56) References Cited

U.S. PATENT DOCUMENTS 5,162,627 A * 11/1992 Dufournet ..... H01H 33/91 218/62
5,561,280 A * 10/1996 Blatter ..... H01H 33/904 218/59
2001/0040146 A1* 11/2001 Miyo ..... H01H 33/668 218/118
2004/0245083 A1* 12/2004 Sambar ..... H01H 13/503 200/520
2009/0045170 A1 2/2009 Shimizu et al.
2009/0166168 A1 7/2009 Nakauchi et al.
2013/0168357 A1* 7/2013 Yaginuma ..... H01H 33/901 218/57
2014/0190939 A1* 7/2014 Yang ..... H01H 33/42 218/84
2016/0379780 A1* 12/2016 Jimbo ..... H01H 33/88 218/63
2018/0247778 A1* 8/2018 Fujioka ..... H01H 33/12
2019/0108950 A1* 4/2019 Kubota ..... H01H 33/901
2019/0371546 A1* 12/2019 Tsukao ..... H01H 33/045

FOREIGN PATENT DOCUMENTS

JP H08235954 A 9/1996
JP 2009048789 A 3/2009
JP 2009163946 A 7/2009

OTHER PUBLICATIONS

Extended European Search Report dated Oct. 30, 2020 for corresponding European Patent Application No. 17932325.8, 8 pages.

* cited by examiner

SWITCHGEAR

FIELD

The present invention relates to a switchgear that includes a fixed contact and a movable contact.

BACKGROUND

In a switchgear, a circuit is connected and disconnected by contact and separation between a fixed contact and a movable contact. Examples of switchgears include a grounding switch used for grounding a main circuit when checking equipment. As described in Patent Literature 1, for grounding a main circuit, a movable contact on the grounding side is moved to be brought into contact with a fixed contact on the main circuit side. For bringing the movable contact into contact with the fixed contact, the main circuit is disconnected in advance in a state in which no voltage is applied to the fixed contact.

CITATION LIST

Patent Literature

Patent Literature 1: Japanese Patent Application Laid-open No. 2009-163946

SUMMARY

Technical Problem

Some of such switchgears are required to be reliable in that connection is safely achieved even in a case where the movable contact is erroneously brought into contact with the fixed contact in a state in which the main circuit is closed without being disconnected. In order to achieve the reliability, the duration of an arc occurring between the movable contact and the fixed contact needs to be shortened. Thus, the movable contact is moved at high speed in an attempt to shorten the time from formation of an arc until the movable contact comes in contact with the fixed contact. In order to move the movable contact at high speed, an operating device that generates a large driving force is needed. The increase in the size of the operating device is therefore a problem.

In addition, collision load caused when the movable contact moving at high speed comes into contact with the fixed contact may damage the movable contact or the fixed contact.

The present invention has been made in view of the above, and an object thereof is to provide a switchgear capable of shortening the duration of an arc while reducing the size of an operating device and protecting a contact.

Solution to Problem

To solve the aforementioned problems and achieve the object, the present invention provides a switchgear including: a movable part capable of reciprocating movement including movement in a first direction and movement in a second direction opposite to the first direction; a movable contact coupled to the movable part on a side of the first direction, the movable contact being capable of reciprocating movement including movement in the first direction and movement in the second direction relative to the movable part; a biasing member that biases the movable contact in the first direction relative to the movable part; a latch part capable of switching between a first state in which movement of the movable contact in the first direction is restricted and a second state in which movement of the movable contact in the first direction is permitted; an accommodating part that accommodates the movable part and the movable contact therein, the accommodating part having an opening through which one end side of the movable contact passes, the one end side being a side of the first direction; a fixed contact provided outside of the accommodating part and on a side of the first direction with respect to the movable contact; and a moving part that moves with the movable contact when the movable contact moves in the first direction. The movable part and the movable contact move in the first direction from initial positions at which the movable contact is away from the fixed contact to closed positions at which the movable contact is in contact with the fixed contact. In a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the biasing member after the movement of the movable contact was restricted, the latch part is switched to the second state in which the movement of the movable contact in the first direction is permitted. The accommodating part contains a first region and a second region within a range of the movement of the moving part, the second region being on a side of the first direction with respect to the first region. The second region has an inner diameter smaller than that of the first region.

Advantageous Effects of Invention

A switchgear according to the present invention provides an effect of shortening the duration of an arc while reducing the size of an operating device and protecting a contact.

DESCRIPTION OF EMBODIMENTS

A switchgear according to certain embodiments of the present invention will be described in detail below with reference to the drawings. Note that the present invention is not limited to the embodiments.

First Embodiment

Figure 1:
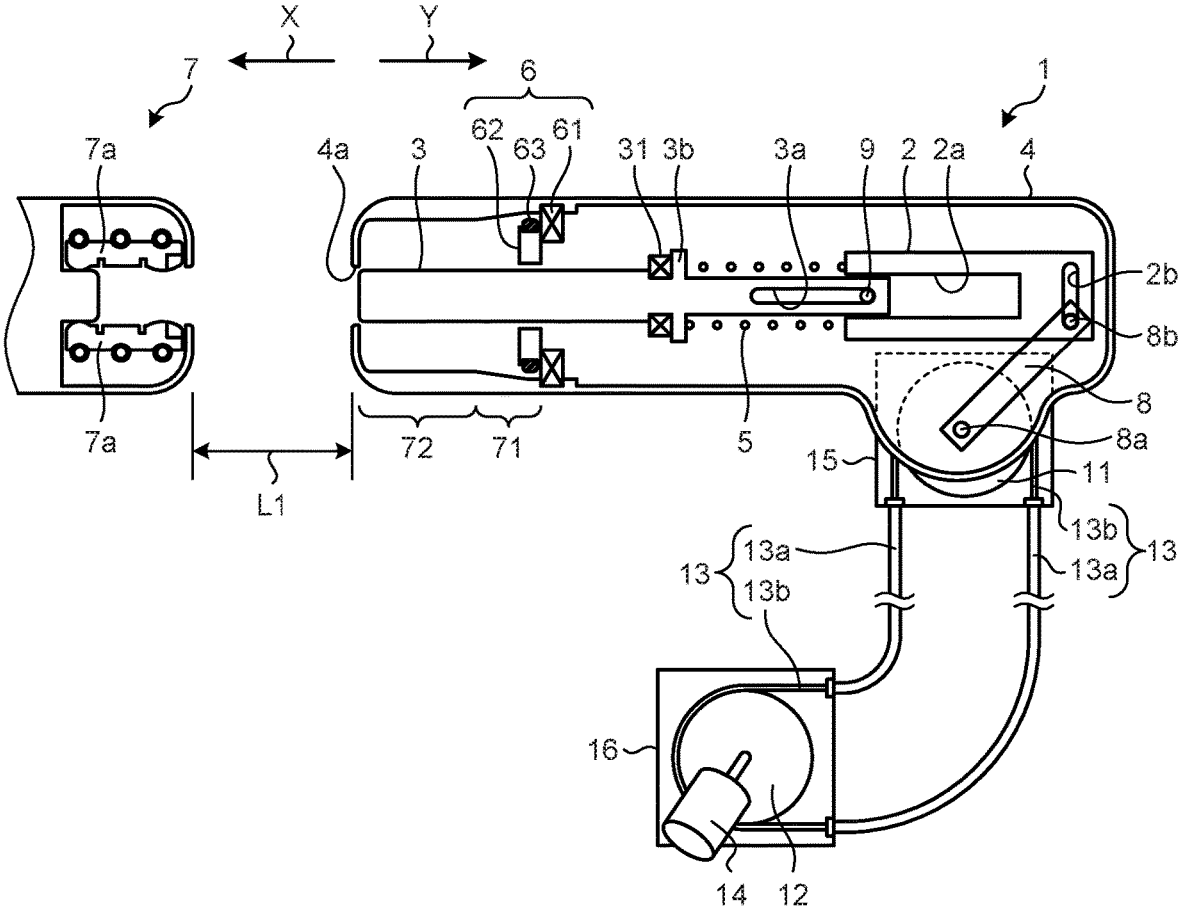
FIG. 1 is a cross-sectional view illustrating a schematic configuration of a switchgear according to a first embodiment of the present invention.
Figure 4:
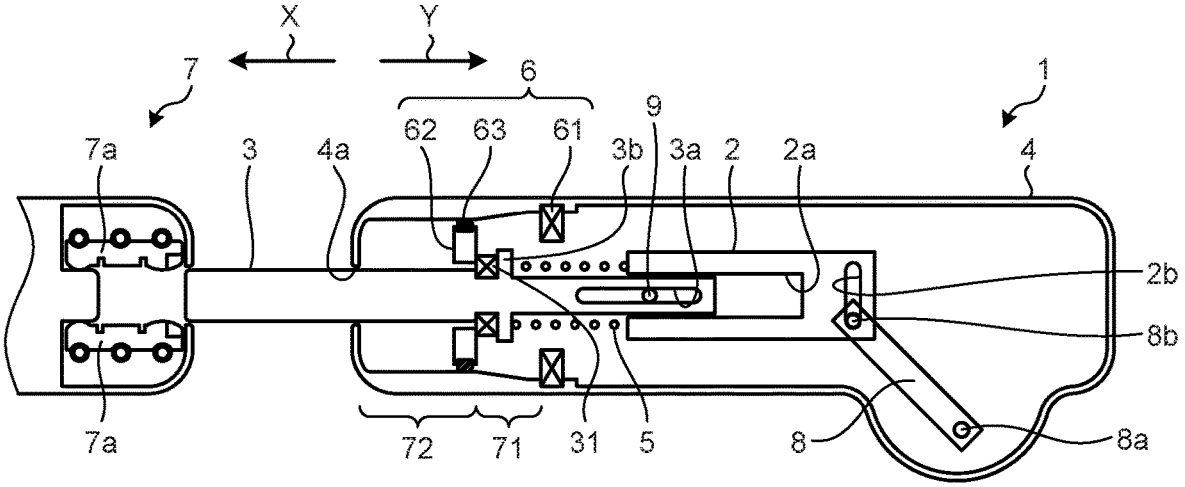
FIG. 4 is a cross-sectional view explaining the closing operation in the switchgear according to the first embodiment.
Figure 5:
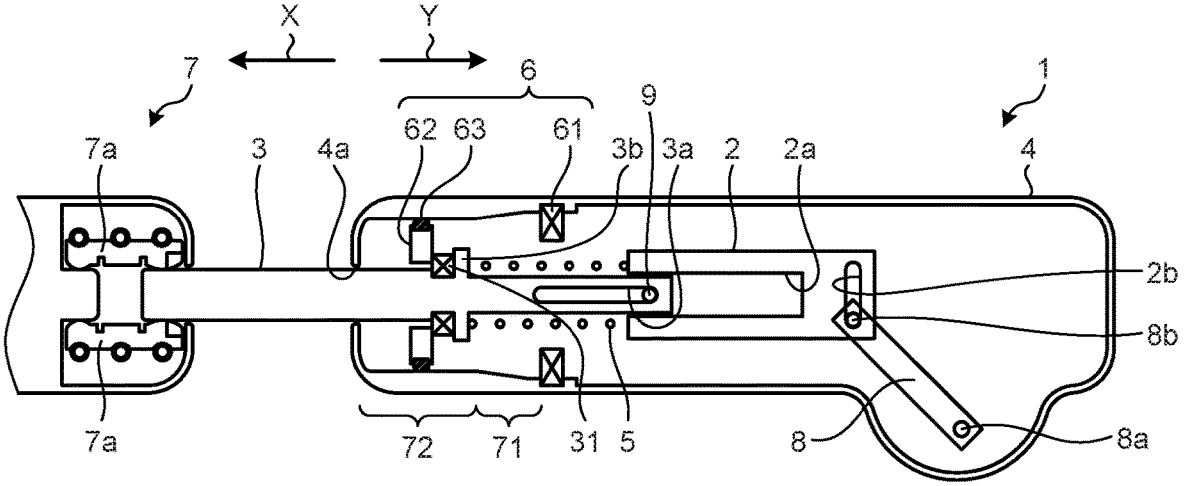
FIG. 5 is a cross-sectional view explaining the closing operation in the switchgear according to the first embodiment.
Figure 6:
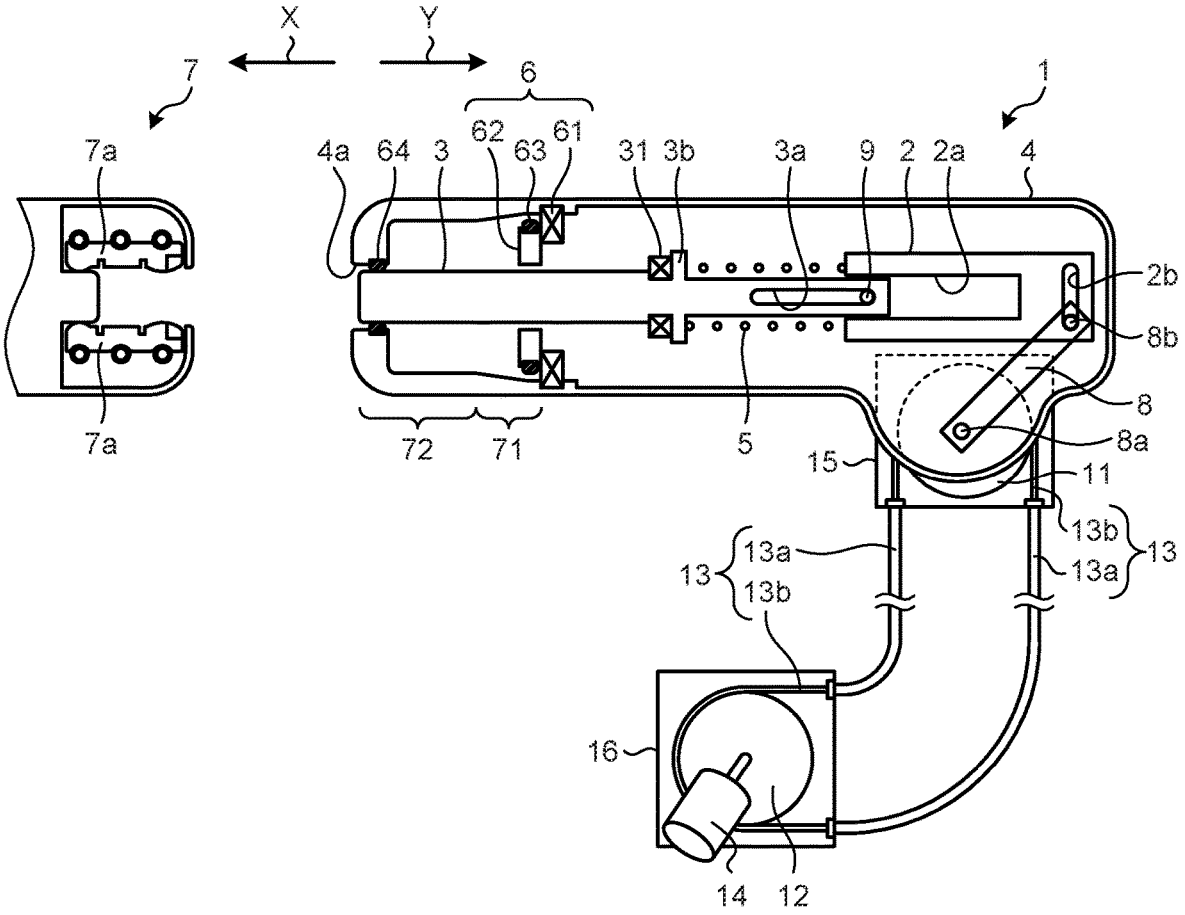
FIG. 6 is a cross-sectional view illustrating a schematic configuration of a switchgear according to a first modification of the first embodiment.

FIG. 1 is a cross-sectional view illustrating a schematic configuration of a switchgear according to a first embodiment of the present invention. FIGS. 2 to 5 are cross-sectional views explaining closing operation in the switchgear according to the first embodiment. FIGS. 5 and 6 are cross-sectional views explaining opening operation in the switchgear according to the first embodiment. A switchgear 1, which is a grounding switch, is used in a tank (illustration is omitted) in which insulating gas having electrically insulating and arc-extinguishing properties, such as sulfur hexafluoride ($SF_6$) gas is enclosed. The switchgear 1 includes a movable part 2, a movable contact 3, a spring 5, a frame 4, a latch part 60, a fixed contact 7, a lever 8, and a motor 14.

The movable part 2 is capable of reciprocating movement toward a direction indicated by an arrow X, which is a first direction, and toward a direction indicated by an arrow Y, which is a second direction opposite to the first direction. The movable part 2 has a hole 2*a* extending from an end thereof on the side of the direction indicated by the arrow X toward the direction indicated by the arrow Y. A pin 9 is provided inside the hole 2*a* of the movable part 2. A groove 2*b* extending in a direction perpendicular to the moving direction of the movable part 2 is formed on the movable part 2.

The movable contact 3 is located on the side of the direction indicated by the arrow X with respect to the movable part 2 and coupled to movable part 2. More specifically, an end of the movable contact 3 on the side of the direction indicated by the arrow Y is inserted in the hole 2*a* of the movable part 2. Because the movable contact 3 is inserted in the hole 2*a*, the movable contact 3 is capable of reciprocating movement relative to the movable part 2 toward the direction indicated by the arrow X and toward the direction indicated by the arrow Y.

A groove 3*a* extending along the moving direction of the movable contact 3 is formed at an end on the side of the direction indicated by the arrow Y of the movable contact 3. The pin 9 provided inside the hole 2*a* of the movable part 2 is inserted in the groove 3*a*. The pin 9 is caught by an end of the groove 3*a*, which prevents the movable contact 3 from moving excessively in the direction indicated by the arrow X and falling off from the hole 2*a*. The movable contact 3 has a projecting portion 3*b* projecting in a direction perpendicular to the moving direction. Note that, in the following description, part of the movable contact 3 on the side of the direction indicated by the arrow X with respect to the projecting portion 3*b* will be referred to as a distal part, and part of the movable contact 3 on the side of the direction indicated by the arrow Y with respect to the projecting portion 3*b* will be referred to as a base part. Thus, the groove 3*a* mentioned above is formed on the base part of the movable contact 3. In addition, the distal part of the movable contact 3 serves as a contact brought in contact with the fixed contact 7 as the movable contact 3 moves in the direction indicated by the arrow X. A second magnet 31 is provided on the side of the direction indicated by the arrow X with respect to the projecting portion 3*b*.

The spring 5 is a helical compression spring provided between an end face of the movable part 2 on the side of the direction indicated by the arrow X and the projecting portion 3*b* of the movable contact 3. The spring 5 is a biasing member that biases the movable contact 3 in the direction indicated by the arrow X relative to the movable part 2. As described above, even when the movable contact 3 is moved in the direction indicated by the arrow X by the biasing force of the spring 5, the pin 9 is caught by the end of the groove 3*a* of the movable contact 3, and thus the movable contact 3 does not fall off from the hole 2*a* of the movable part 2.

The frame 4 is an accommodating part that accommodates the movable part 2 and the movable contact 3 therein. The frame 4 has an opening 4*a* through which the distal part of the movable contact 3 can pass. The distal part of the movable contact 3 protrudes outside of the frame 4 through the opening 4*a* as the movable contact 3 moves in the direction indicated by the arrow X.

The latch part 6 includes a first magnet 61 fixed to the inside of the frame 4, and a metallic member 62. As illustrated in FIG. 1, the first magnet 61 and the metallic member 62 constituting the latch part 6 are located on the side of the direction indicated by the arrow X with respect to the projecting portion 3*b* of the movable contact 3 in a state in which the movable part 2 and the movable contact 3 are at positions after having moved in the direction indicated by the arrow Y. Note that the positions of the movable part 2 and the movable contact 3 in a state in which the movable contact 3 is away from the fixed contact 7 as illustrated in FIG. 1 will be referred to as initial positions.

The metallic member 62 is attracted by the first magnet 61 from the side of the direction indicated by the arrow X when the movable part 2 and the movable contact 3 are at the initial positions. The metallic member 62 has an annular shape as viewed along the direction indicated by the arrow X. The metallic member 62 has an opening that allows passage of the distal part of the movable contact 3 but does not allow passage of the second magnet 31 provided on the movable contact 3. A sealing member 63 is provided around an outer edge of the metallic member 62 having the annular shape. The sealing member 63 covers around the entire outer edge of the metallic member 62. The sealing member 63 is made of rubber, for example. The metallic member 62 and the sealing member 63 constitute a moving part that moves with the movable contact 3 when the movable contact 3 moves in the direction indicated by the arrow X.

The second magnet 31 provided on the movable contact 3 comes in contact with part of the metallic member 62 avoiding the first magnet 61 from the side of the direction indicated by the arrow Y when the movable contact 3 has moved a predetermined distance in the direction indicated by the arrow X from the initial position.

Figure 2:
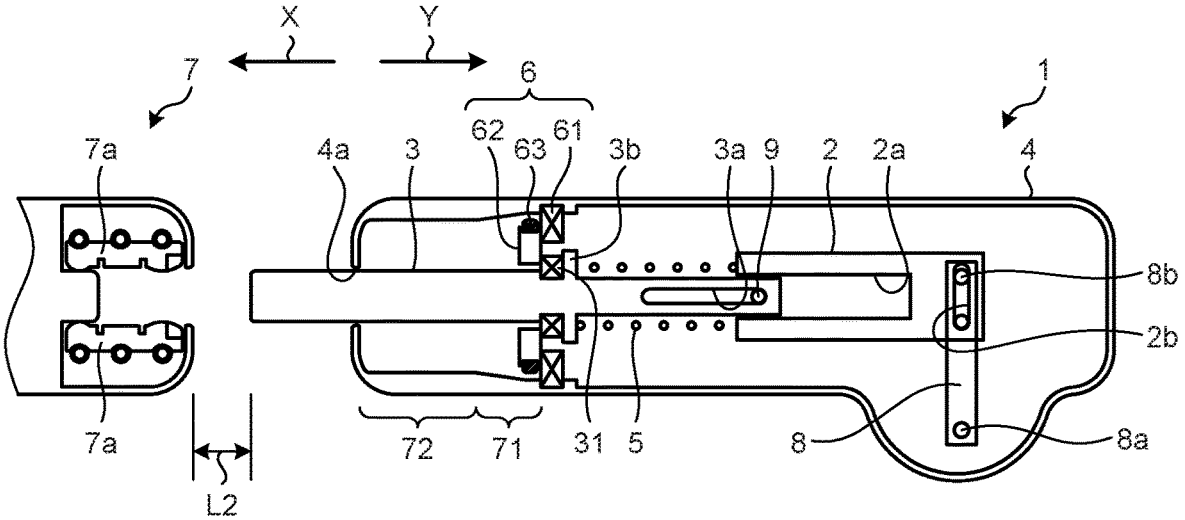
FIG. 2 is a cross-sectional view explaining closing operation in the switchgear according to the first embodiment.

As illustrated in FIG. 2, as the movable contact 3 moves from the initial position in the direction indicated by the arrow X, the second magnet 31 of the movable contact 3 comes into contact with the metallic member 62. Because metallic member 62 is attracted by the first magnet 61, further movement of the movable contact 3 in the direction indicated by the arrow X is restricted. A state of the latch part 6 capable of restricting the movement of the movable contact 3 in the direction indicated by the arrow X in this manner will be referred to as a first state. Specifically, a state in which the metallic member 62 is attracted by the first magnet 61 is the first state. At the initial positions, however, the second magnet 31 is not in contact with the metallic member 62, and the movement of the movable contact 3 is not restricted although the latch part 6 is in the first state.

Figure 3:
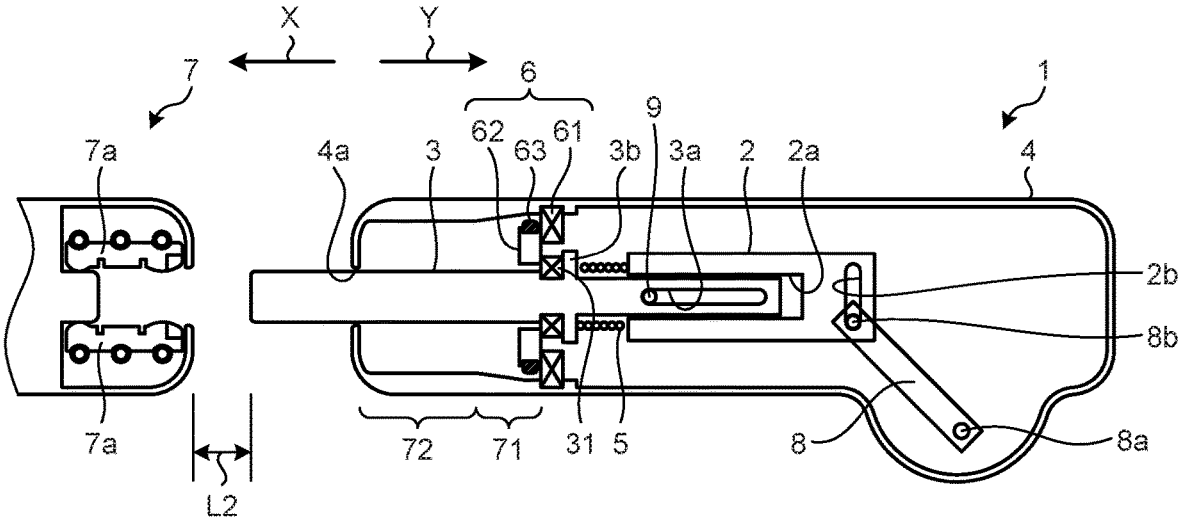
FIG. 3 is a cross-sectional view explaining the closing operation in the switchgear according to the first embodiment.

Subsequently, as the movable part 2 moves further in the direction indicated by the arrow X against the biasing force of the spring 5 in the state in which the movement of the movable contact 3 in the direction indicated by the arrow X is restricted, the spring 5 is compressed and the force thereof is accumulated as illustrated in FIG. 3. When the force accumulated in the spring 5 exceeds the attractive force between the first magnet 61 and the metallic member 62, the metallic member 62 leaves the first magnet 61 and the movement of the movable contact 3 in the direction indicated by the arrow X is permitted as illustrated in FIG. 4. Such a state in which the metallic member 62 is away from the first magnet 61 and the movement of the movable contact 3 in the direction indicated by the arrow X is permitted will be referred to as a second state.

The lever 8 is a rod-like member located inside the frame 4 and being rotatable about a shaft 8*a*. The lever 8 includes a pin 8*b* inserted in the groove 2*b* of the movable part 2. As the lever 8 turns with the pin 8*b* being inserted in the groove 2*b*, the movable part 2 moves linearly in the direction indicated by the arrow X or the direction indicated by the arrow Y.

A first pulley 11 is coupled to the shaft 8*a*. The lever 8 turns with the first pulley 11. The first pulley 11 is supported by a first base 15. A second pulley 12 is provided at a position away from the first pulley 11. The second pulley 12 is turned by the motor 14. The second pulley 12 is supported by a second base 16. Two flexible jackets 13*a* are provided between the first base 15 and the second base 16. The flexible jackets 13*a* have flexibility and a cylindrical shape in which wires 13*b* are inserted. A flexible jacket 13*a* and a wire 13*b* constitute a wire mechanism 13. Each of the flexible jackets 13*a* has one end fixed to the first base 15 and the other end fixed to the second base 16. The wires 13*b* inserted in the flexible jackets 13*a* are slidable along the extending direction of the flexible jackets 13*a*. In addition, the wires 13*b* have a loop shape and are looped around the first pulley 11 and the second pulley 12. As the second pulley 12 turns, the wires 13*b* slide, which causes the first pulley 11 to turn with the turning of the second pulley 12. Thus, as the second pulley 12 is turned by the motor 14, the first pulley 11 and the lever 8 turn, and the movable part 2 moves. In this manner, the motor 14 functions as a driver that moves the movable part 2. In an operating device, the wires 13*b* are slidable along the shapes of the flexible jackets 13*a* between the first pulley 11 and the second pulley 12. Thus, even in a case where the shapes of the flexible jackets 13*a* are changed, the first pulley 11 can be turned with the turning of the second pulley 12. Thus, the shapes of the flexible jackets 13*a* can be changed, so that the second pulley 12 and the motor 14 can be installed at various positions.

The fixed contact 7 is located on the side of the direction indicated by the arrow X with respect to the movable contact 3. The fixed contact 7 has a plurality of contact points 7*a*. As illustrated in FIG. 5, when the distal part of the movable contact 3 is inserted between the contact points 7*a*, the fixed contact 7 and the movable contact 3 come into contact with each other. In a case where the switchgear 1 is a grounding switch in which the fixed contact 7 is on the main circuit side and the movable contact 3 is on the grounding side, the main circuit is grounded when the fixed contact 7 and the movable contact 3 are in contact with each other. As illustrated in FIG. 5, the positions of the movable part 2 and the movable contact 3 in a state in which the movable contact 3 is in contact with the fixed contact 7 will be referred to as closed positions.

Next, the shape of the inside of the frame 4 will be described. First, a first region 71 and a second region 72, which is on the side of the direction indicated by the arrow X with respect to the first region 71, are located inside the frame 4 within a range in which the metallic member 62 and the sealing member 63, which constitute the moving part, move in a process in which the movable contact 3 moves from the initial position to the closed position. The first region 71 and the second region 72 have a cylindrical shape as viewed along the direction indicated by the arrow X.

The first region 71 has a tapered shape with the inner diameter decreasing toward the second region 72. The second region 72 has an inner diameter smaller than that of the first region 71 and equal to the outer diameter of the moving part including the metallic member 62 and the sealing member 63. The concept that the inner diameter of the second region 72 is equal to the outer diameter of the moving part herein also includes a case where the inner diameter of the second region 72 is slightly larger than the outer diameter of the moving part and a case where the inner diameter of the second region 72 is slightly smaller than the outer diameter of the moving part. In the case where the inner diameter of the second region 72 is slightly larger than the outer diameter of the moving part, a gap is present between the inner face of the second region 72 and the sealing member 63 of the moving part when the moving part passes through the second region 72. In contrast, in the case where the inner diameter of the second region 72 is exactly equal to or slightly smaller than the outer diameter of the moving part, the inner face of the second region 72 is in close contact with the sealing member 63 of the moving part when the moving part passes through the second region 72. When the moving part is in the second region 72, less insulating gas can pass between the inner face of the second region 72 and the sealing member 63.

In addition, the gap between the inner face of the first region 71 and the sealing member 63 of the moving part when the moving part passes through the first region 71 is larger than the gap between the inner face of the second region 72 and the sealing member 63 of the moving part when the moving part passes through the second region 72. Alternatively, the first region 71 may have a shape with a uniform inner diameter instead of the tapered shape and a step may be formed between the first region 71 and the second region 72; in terms of mitigating concentration on electric field inside the frame 4, however, it is preferable that the first region 71 and the second region 72 be smoothly connected without any step therebetween. When the moving part is in the first region 71, the insulating gas can pass smoothly through the gap present between the inner face of the first region 71 and the sealing member 63.

Next, closing operation in which the movable part 2 and the movable contact 3 move from the initial positions to the closed positions will be explained. As the movable part 2 and the movable contact 3 move a predetermined distance in the direction indicated by the arrow X as illustrated in FIG. 2 from the initial positions illustrated in FIG. 1, the second magnet 31 provided on the movable contact 3 comes into contact with metallic member 62, which is the latch part 6. The latch part 6 is in the first state in which the metallic member 62 is attracted by the first magnet 61, and further movement of the movable contact 3 in the direction indicated by the arrow X is restricted.

Subsequently, as illustrated FIG. 3, as the movable part 2 moves further in the direction indicated by the arrow X against the biasing force of the spring 5 in the state in which the movement of the movable contact 3 in the direction indicated by the arrow X is restricted, the spring 5 is compressed and the force thereof is accumulated. When the force accumulated in the spring 5 exceeds the attractive force between the first magnet 61 and the metallic member 62, the state is switched to the second state in which the metallic member 62 is away from the first magnet 61 and the movement of the movable contact 3 in the direction indicated by the arrow X is permitted as illustrated in FIG. 4. The movable contact 3 then further moves in the direction indicated by the arrow X, the distal part of the movable contact 3 is inserted between the contact points 7*a*, the movable contact 3 and the fixed contact 7 come into contact with each other, as illustrated in FIG. 5, and the closing operation is thus completed. At this point, the movable part 2 and the movable contact 3 are at the closed positions.

The moving speed of the movable contact 3 in the process from the state illustrated in FIG. 3 to the state illustrated in FIG. 5 will now be explained. When the movement of the movable contact 3 in the direction indicated by the arrow X is permitted, the force accumulated in the spring 5 is released, which causes the movable contact 3 to move in the direction indicated by the arrow X at a speed higher than the moving speed of the movable part 2 before the release.

In the process until the metallic member 62 and the sealing member 63 reach the second region 72, that is, from the state illustrated in FIG. 3 to the state illustrated in FIG. 4, the insulating gas smoothly moves through the gap present between the inner face of the first region 71 and the sealing member 63. Thus, even when the volume of a space surrounded by the frame 4 and the metallic member 62 on the side of the direction indicated by the arrow X with respect to the metallic member 62 decreases as the metallic member 62 and the sealing member 63 move in the direction indicated by the arrow X, the insulating gas can move smoothly through the gap present between the inner face of the first region 71 and the sealing member 63, and thus the movable contact 3 moves at high speed.

In contrast, while the metallic member 62 and the sealing member 63 pass through the second region 72, that is, from the state illustrated in FIG. 4 to the state illustrated in FIG. 5, less insulating gas can pass between the inner face of the second region 72 and the sealing member 63. Thus, when the volume of the space surrounded by the frame 4 and the metallic member 62 on the side of the direction indicated by the arrow X with respect to the metallic member 62 decreases as the metallic member 62 and the sealing member 63 move in the direction indicated by the arrow X, the insulating gas is compressed. Reaction force generated when the insulating gas is compressed decreases the moving speed of the movable contact 3. Thus, the moving speed of the movable contact 3 during the process in which the metallic member 62 and the sealing member 63 pass through the second region 72 is lower than that during the process in which the metallic member 62 and the sealing member 63 pass through the first region 71.

Setting the position at which the metallic member 62 and the sealing member 63 reach the boundary between the first region 71 and the second region 72 to be immediately before the movable contact 3 and the fixed contact 7 come into contact with each other enables the moving speed of the movable contact 3 to be decreased immediately before the movable contact 3 and the fixed contact 7 come into contact with each other.

Next, opening operation in which the movable part 2 and the movable contact 3 move from the closed positions to the initial positions will be explained. As the movable part 2 moves in the direction indicated by the arrow Y from the closed position, the movable contact 3 is caught by the pin 9 and thus also moves in the direction indicated by the arrow Y. As a result, the movable contact 3 is separated from the fixed contact 7. In this process, the metallic member 62 is attracted by the second magnet 31 and moves together with the movable contact 3 as illustrated in FIG. 4. In addition, the metallic member 62 comes in contact with the first magnet 61, and further movement in the direction indicated by the arrow Y is thus restricted as illustrated in FIG. 3.

Furthermore, as the movable part 2 and the movable contact 3 move in the direction indicated by the arrow Y, the second magnet 31 is separated from the metallic member 62, and the movable part 2 and the movable contact 3 return to the initial positions as illustrated in FIG. 1. At this point, the metallic member 62 is attracted by the first magnet 61, and the latch part 6 is in the first state.

In the switchgear 1 having the configuration as described above, the movable part 2 and the movable contact 3 do not move at high speeds until the movement of the movable contact 3 becomes restricted and the force is accumulated in the spring 5 as illustrated in FIG. 3. Subsequently, as illustrated in FIG. 4, when the latch part 6 is switched to the second state, the movable contact 3 moves at high speed.

The distance L1 between the movable contact 3 and the fixed contact 7 at the initial positions is set to such a distance with which an arc is less likely to occur between the movable contact 3 and the fixed contact 7 even when an abnormal voltage exceeding a steady state is applied to a main circuit connected with the fixed contact 7, such as when the main circuit is hit by lightning, for example. In addition, the distance L2 between the movable contact 3 and the fixed contact 7 in the state in which the movement is restricted by the latch part 6, that is, in the state illustrated in FIGS. 2 and 3 is set to such a distance with which no arc occurs when a steady state voltage is applied to a main circuit connected with the fixed contact 7 and which is shorter than the distance L1.

Thus, in a process of moving the movable contact 3 from the initial position to a position where the distance to the fixed contact 7 is L2 and thereafter accumulating the force in the spring 5, no arc will occur in a state in which the steady state voltage is applied to the main circuit, and the movable part 2 and the movable contact 3 may therefore be moved at low speeds. This enables the driving force for moving the movable part 2 to be reduced. As a result, the operating device for moving the movable part 2 can be constituted by the first pulley 11, the second pulley 12, the wire mechanisms 13, and the motor 14, which enables reduction in size as compared to an operating device in which the motor 14 and the lever 8 are connected by a rigid member therebetween. In addition, the lengths of the flexible jackets 13*a* and the wires 13*b* can be changed and the shapes of the flexible jackets 13*a* can be changed, which enables the second pulley 12 and the motor 14 to be placed at various positions. As a result, the second pulleys 12 and the motors 14 of a plurality of operating devices can be placed together, which improves the maintenance efficiency. Note that looping of a plurality of wires 13*b* around the second pulley 12 enables turning of a plurality of first pulleys 11 by one motor 14, that is, movement of a plurality of movable parts 2 and movable contacts 3 by one motor 14, which further improves the maintenance efficiency and reduces the size of the operating device. Note that, in FIGS. 2 to 5, the operating device is not illustrated.

In addition, in a range in which the distance between the movable contact 3 and the fixed contact 7 is shorter than L2, that is, in a range in which an arc may occur, the movable contact 3 can be moved at high speed with use of the force accumulated in the spring 5. Thus, in the range in which an arc may occur, the movable contact 3 is moved at high speed so that the movable contact 3 is brought into contact with the fixed contact 7 in a shorter time, which shortens the duration of an arc.

In the switchgear 1, because the movable contact 3 is moved at high speed only in the range in which arc may occur in the state in which a steady state voltage is applied to the main circuit, less energy is required of the operating device than a case where the movable contact 3 is moved at high speed in all ranges from the initial positions to the closed positions. Thus, use of the pulleys and the like as described above enables reduction in the size of the operating device.

In addition, setting the position at which the metallic member 62 and the sealing member 63 reach the boundary between the first region 71 and the second region 72 to be immediately before the movable contact 3 and the fixed contact 7 come into contact with each other enables the moving speed of the movable contact 3 to be decreased immediately before the movable contact 3 and the fixed contact 7 come into contact with each other. This prevents damage on the movable contact 3 or the fixed contact 7 due to collision load caused when the movable contact 3 moving at high speed comes into contact with the fixed contact 7. Thus, in the switchgear 1, the movable contact 3 is moved at high speed so that the duration of an arc is shortened within the range in which an arc may occur, and the movable contact 3 is decelerated immediately before the movable contact 3 hits the fixed contact 7 so that the movable contact 3 and the fixed contact 7 are protected.

Figure 7:
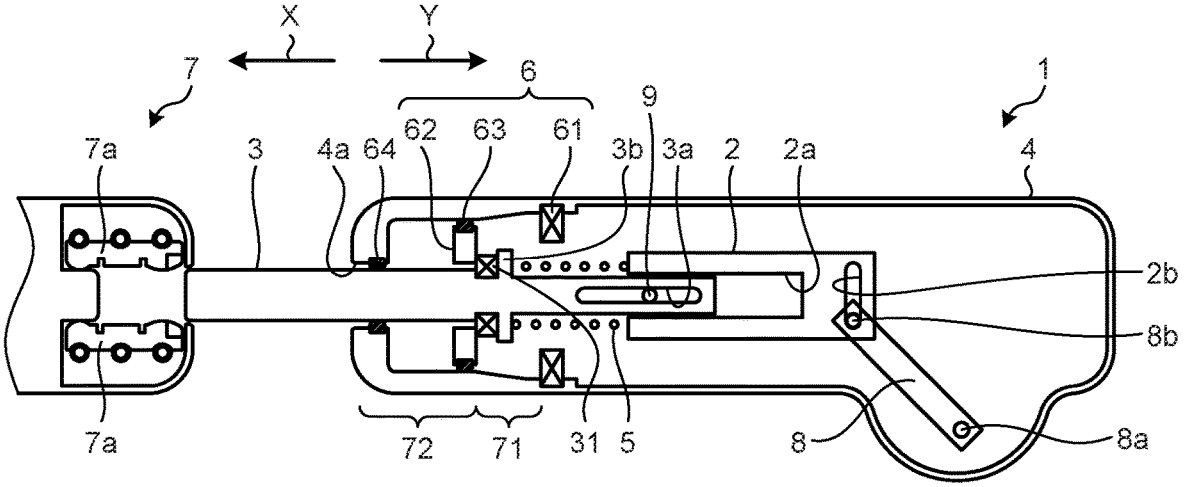
FIG. 7 is a cross-sectional view illustrating a schematic configuration of the switchgear according to the first modification of the first embodiment in a state in which a metallic member and a sealing member pass through a second region.

FIG. 6 is a cross-sectional view illustrating a schematic configuration of a switchgear 1 according to a first modification of the first embodiment. FIG. 7 is a cross-sectional view illustrating a schematic configuration of the switchgear 1 according to the first modification of the first embodiment in a state in which the metallic member 62 and the sealing member 63 pass through the second region 72.

In the switchgear 1 according to the first modification, a blocking member 64 that blocks the gap between the opening 4*a* of the frame 4 and the distal part of the movable contact 3 is attached in the opening 4*a*. The blocking member 64 is made of rubber, for example. The blocking member 64 need not necessarily be in contact with the distal part of the movable contact 3, but a gap may be present between the blocking member 64 and the distal part of the movable contact 3. As a result of provision of the blocking member 64, less insulating gas moves between the distal part of the movable contact 3 and the opening 4*a*.

As illustrated in FIG. 7, when the volume of the space surrounded by the frame 4 and the metallic member 62 on the side of the arrow X with respect to the metallic member 62 decreases as the movable contact 3 moves in the direction indicated by the arrow X and the metallic member 62 and the sealing member 63 pass through the second region 72, less insulating gas can pass between the distal part of the movable contact 3 and the opening 4*a*, and the reaction force generated when the insulating gas is compressed thus becomes greater. Thus, in the switchgear 1 according to the first modification, the movable contact 3 is significantly decelerated immediately before the movable contact 3 hits the fixed contact 7, which protects the movable contact 3 and the fixed contact 7.

Figure 8:
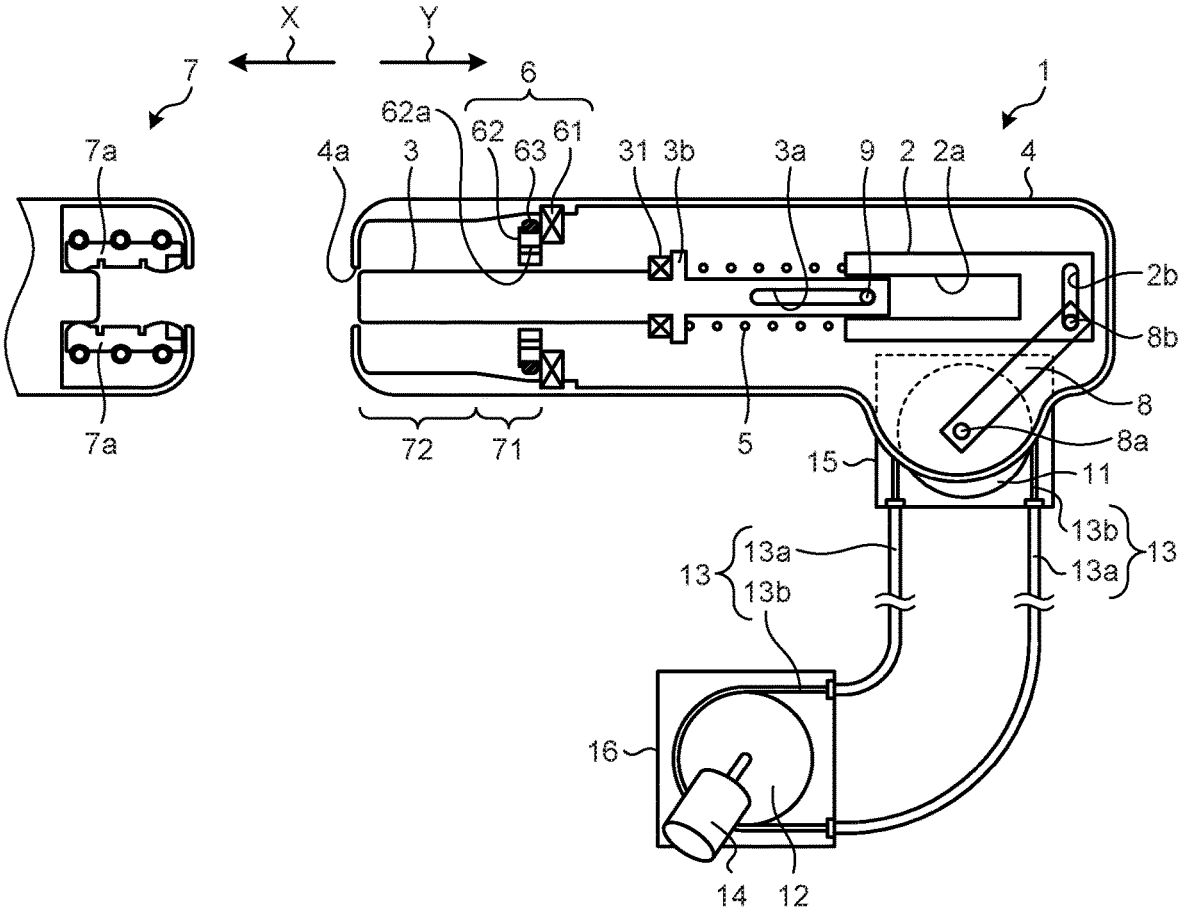
FIG. 8 is a cross-sectional view illustrating a schematic configuration of a switchgear according to a second modification of the first embodiment.
Figure 9:
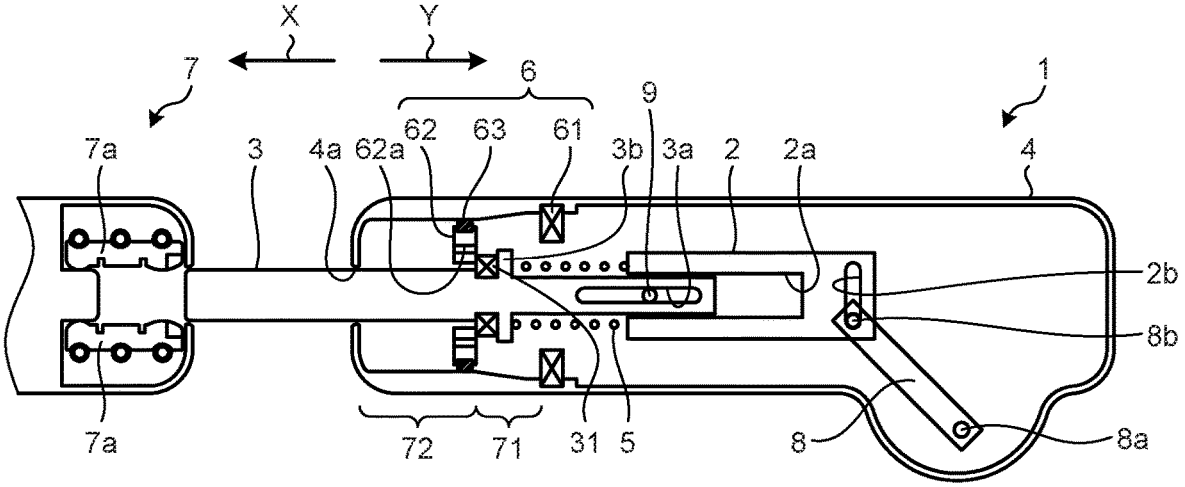
FIG. 9 is a cross-sectional view illustrating a schematic configuration of the switchgear according to the second modification of the first embodiment in a state in which a metallic member and a sealing member pass through a second region.

FIG. 8 is a cross-sectional view illustrating a schematic configuration of a switchgear 1 according to a second modification of the first embodiment. FIG. 9 is a cross-sectional view illustrating a schematic configuration of the switchgear 1 according to the second modification of the first embodiment in a state in which the metallic member 62 and the sealing member 63 pass through the second region 72.

In the switchgear 1 according to the second modification, a through-hole 62*a* extending through the metallic member 62 from the side of the direction indicated by the arrow X to the side of the direction indicated by the arrow Y is formed. As illustrated in FIG. 9, when the volume of the space surrounded by the frame 4 and the metallic member 62 on the side of the arrow X with respect to the metallic member 62 decreases as the movable contact 3 moves in the direction indicated by the arrow X and the metallic member 62 and the sealing member 63 pass through the second region 72, the insulating gas can move through the through-hole 62*a*. Thus, when the through-hole 62*a* is made larger so that more insulating gas can move, the reaction force generated when the insulating gas is compressed becomes smaller, which reduces the effect of deceleration of the movable contact 3. In contrast, when the through-hole 62*a* is made smaller so that less insulating gas can move, the reaction force generated when the insulating gas is compressed becomes greater, which increases the effect of deceleration of the movable contact 3. In this manner, the effect of deceleration of the movable contact 3 can be adjusted by the size of the through-hole 62*a* formed through the metallic member 62.

Figure 10:
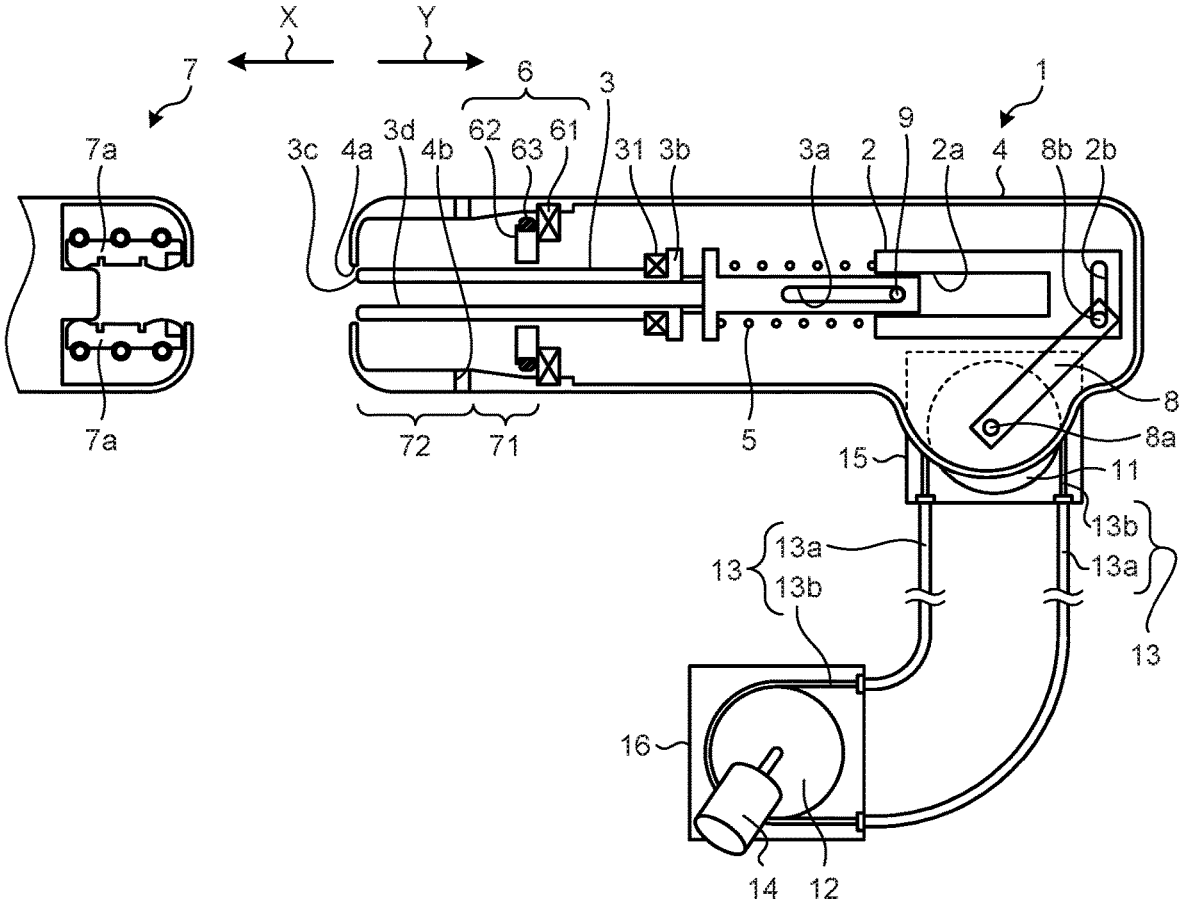
FIG. 10 is a cross-sectional view illustrating a schematic configuration of a switchgear according to a third modification of the first embodiment.
Figure 11:
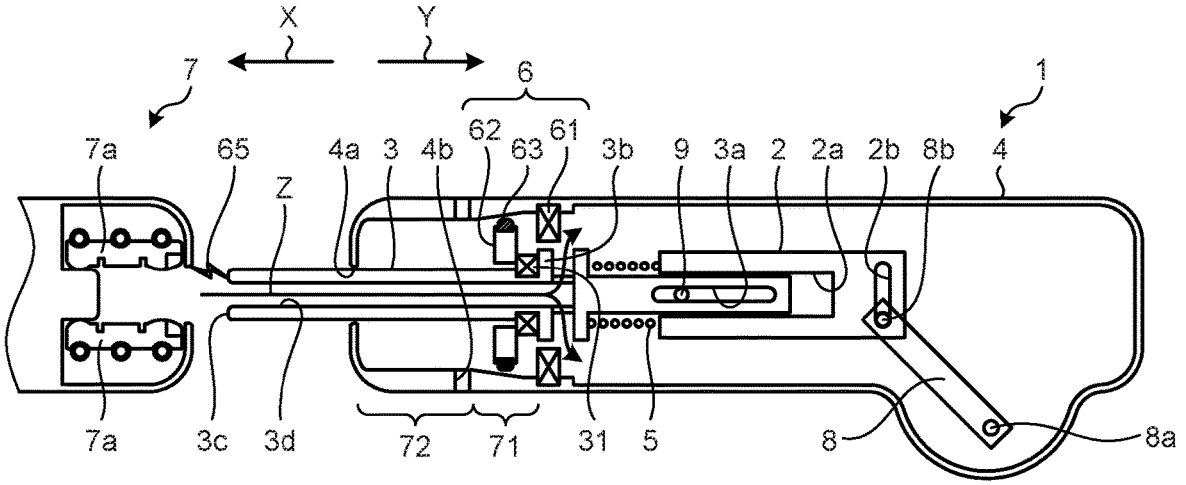
FIG. 11 is a cross-sectional view illustrating a schematic configuration of the switchgear according to the third modification of the first embodiment in a state in which a metallic member and a sealing member pass through a first region.
Figure 12:
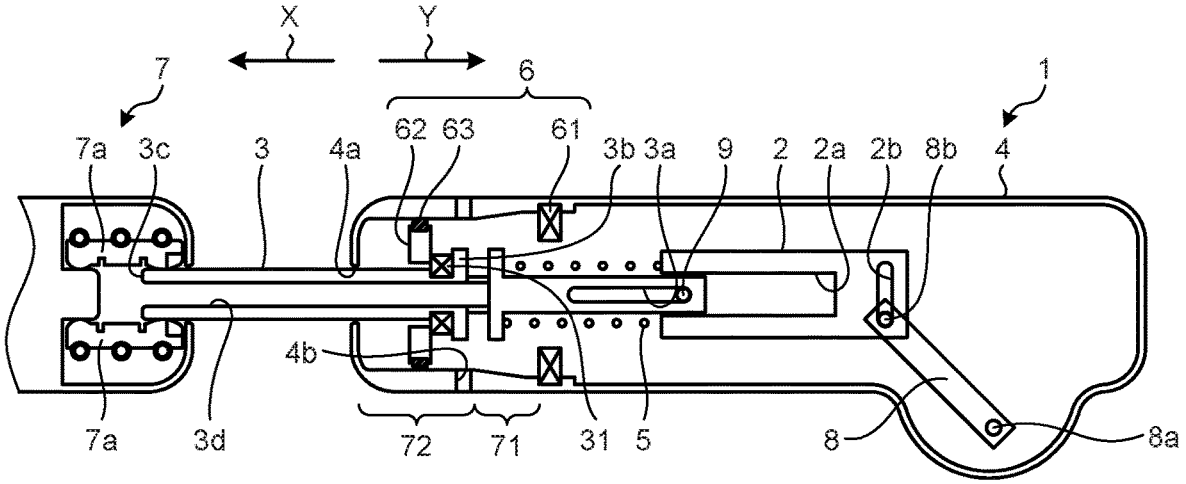
FIG. 12 is a cross-sectional view illustrating a schematic configuration of the switchgear according to the third modification of the first embodiment in a state in which the metallic member and the sealing member pass through a second region.

FIG. 10 is a cross-sectional view illustrating a schematic configuration of a switchgear 1 according to a third modification of the first embodiment. FIG. 11 is a cross-sectional view illustrating a schematic configuration of the switchgear 1 according to the third modification of the first embodiment in a state in which the metallic member 62 and the sealing member 63 pass through the first region 71. FIG. 12 is a cross-sectional view illustrating a schematic configuration of the switchgear 1 according to the third modification of the first embodiment in a state in which the metallic member 62 and the sealing member 63 pass through the second region 72.

In the switchgear 1 according to the third modification, a through-passage 3*d* is formed from an end 3*c* of the movable contact 3 on the side of the direction indicated by the arrow X to a part on the side of the direction indicated by the arrow Y with respect to the metallic member 62 in the second state in which the metallic member 62 is away from the first magnet 61. In addition, a communicating hole 4*b* enabling communication between the inside and the outside of the frame 4 is formed in one of walls of the frame 4 at the boundary between the first region 71 and the second region 72.

As illustrated in FIG. 11, as the movable contact 3 moves in the direction indicated by the arrow X and the end 3*c* approaches the fixed contact 7, an arc 65 is generated at the end 3*c* when a steady state voltage is applied to the main circuit. The generated arc 65 heats and expands the insulating gas. The expanded insulating gas flows through the through-passage 3*d* as indicated by an arrow Z, and into a space on the side of the direction indicated by the arrow Y with respect to the metallic member 62. In addition, the insulating gas compressed in the space on the side of the arrow X with respect to the metallic member 62 flows through the communicating hole 4*b* and to the outside of the frame 4. As a result, the pressure in the space on the side of the direction indicated by the arrow Y with respect to the metallic member 62 is higher than that in the space on the side of the direction indicated by the arrow X with respect to the metallic member 62. The pressure difference between the two spaces acts as a force for moving the metallic member 62 and the movable contact 3 in the direction indicated by the arrow X. The movable contact 3 is thus moved in the direction indicated by the arrow X by the pressure difference between the two spaces in addition to the force accumulated in the spring 5, and is thus capable of moving at a higher speed. As the movable contact 3 moves at a higher speed, the duration of an arc 65 can be shortened.

As the metallic member 62 and the movable contact 3 move further in the direction indicated by the arrow X from the state illustrated in FIG. 11 through the part that is the boundary between the first region 71 and the second region 72 and reach a state in which the metallic member 62 passes through the second region 72 as illustrated in FIG. 12, the position of the communicating hole 4*b* comes on the side of the direction indicated by the arrow Y with respect to the metallic member 62. As a result, the insulating gas flowing through the through-passage 3*d* and into the space on the side of the direction indicated by the arrow Y with respect to the metallic member 62 flows to the outside of the frame 4 through the communicating hole 4*b*.

In the meantime, in the space on the side of the direction indicated by the arrow X with respect to the metallic member 62, the insulating gas compressed as a result of the movement of the metallic member 62 cannot flow out through the communicating hole 4*b* and is thus compressed. Thus, in the state in which the metallic member 62 passes through the second region 72 the reaction force generated when the insulating gas is compressed decelerates the movable contact 3, which protects the movable contact 3 and the fixed contact 7. In addition, because there is no need to provide a decelerator using hydraulic pressure or the like, there is no risk of occurrence of short-circuit faults due to oil leakage in a tank.

Second Embodiment

Figure 13:
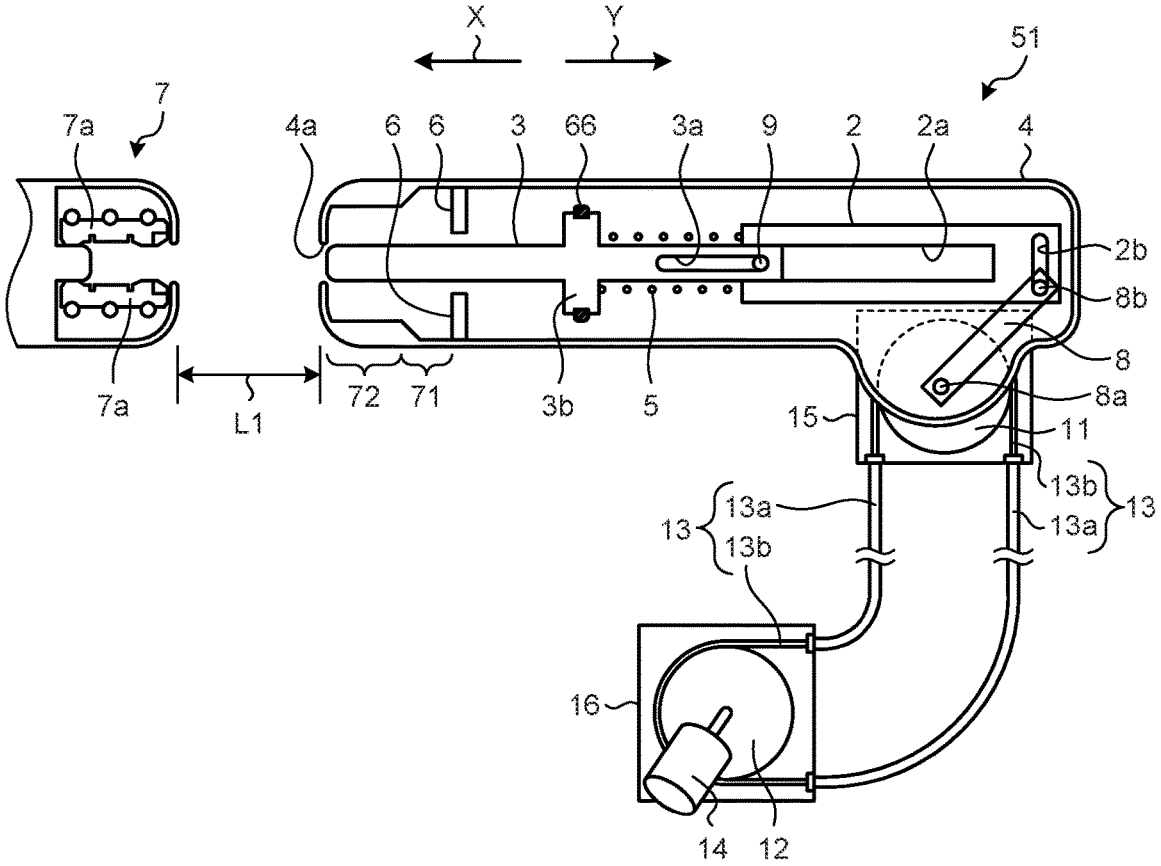
FIG. 13 is a cross-sectional view illustrating a schematic configuration of a switchgear according to a second embodiment of the present invention.
Figure 14:
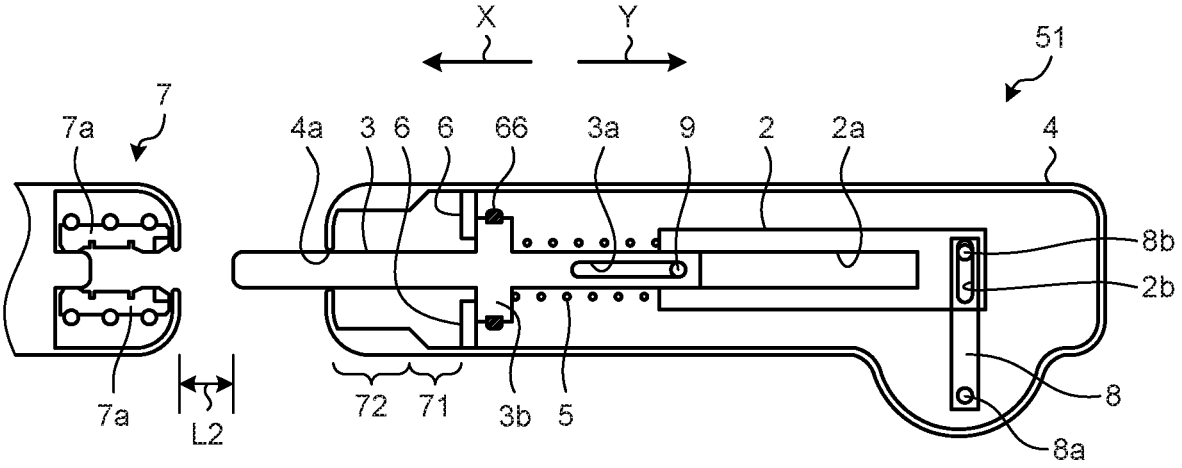
FIG. 14 is a cross-sectional view explaining closing operation in the switchgear according to the second embodiment.
Figure 15:
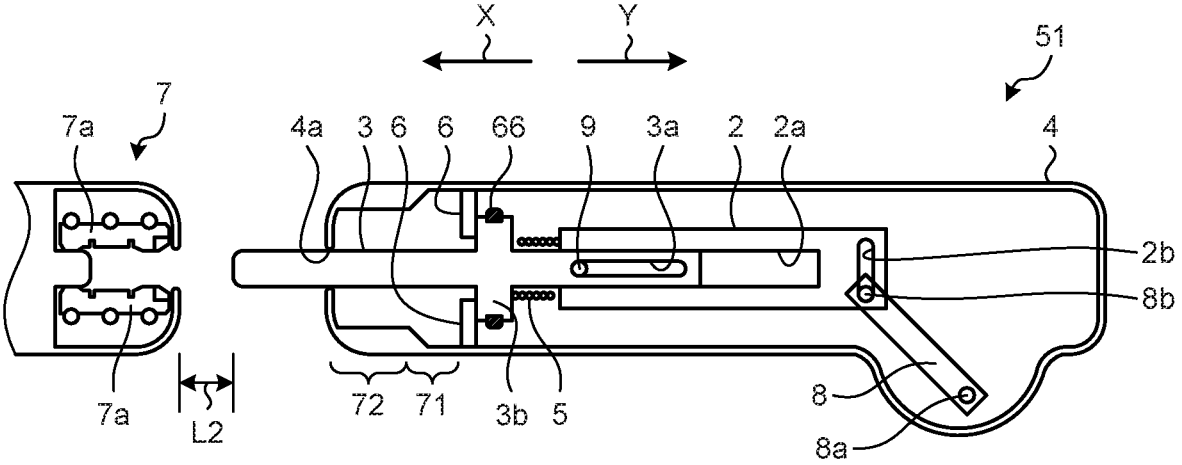
FIG. 15 is a cross-sectional view explaining the closing operation in the switchgear according to the second embodiment.
Figure 16:
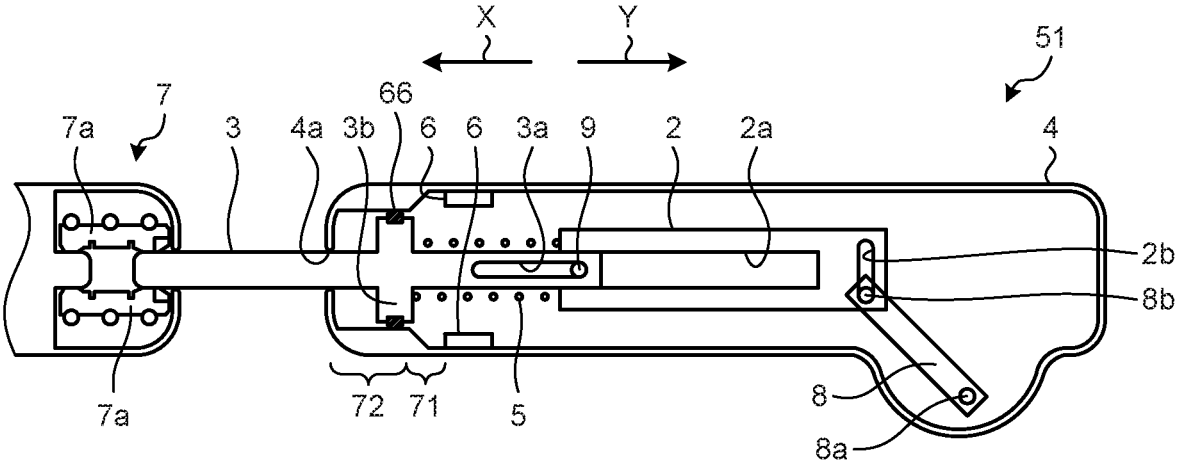
FIG. 16 is a cross-sectional view explaining the closing operation in the switchgear according to the second embodiment.

FIG. 13 is a cross-sectional view illustrating a schematic configuration of a switchgear according to a second embodiment of the present invention. FIGS. 14 to 16 are cross-sectional views explaining closing operation in the switchgear according to the second embodiment. Note that components similar to the components in the first embodiment described above will be represented by the same reference numerals, and detailed description thereof will not be repeated. In addition, in FIGS. 14 to 16, the operating device is not illustrated.

In a switchgear 51 according to the second embodiment, the moving part that moves with the movable contact 3 when the movable contact 3 moves in the direction indicated by the arrow X includes the projecting portion 3*b* formed on the movable contact 3, and a sealing member 66 provided around the projecting portion 3*b*. In addition, in the switchgear 51 according to the second embodiment, the latch part 6 is fixed to the inside of the frame 4.

The latch part 6 has an opening that allows passage of the distal part of the movable contact 3 but does not allow passage of the projecting portion 3*b* of the movable contact 3. The latch part 6 is constituted by a plurality of members, and the opening is formed by a gap between the members. Alternatively, the latch part 6 may be constituted by an annular member having an opening, which constitutes the aforementioned opening, at the center.

As illustrated in FIG. 14, as the movable contact 3 moves from the initial positions in the direction indicated by the arrow X, the projecting portion 3*b* of the movable contact 3 comes into contact with the latch part 6, which restricts further movement of the movable contact 3 in the direction indicated by the arrow X.

As illustrated in FIG. 16, the latch part 6 falls and changes its posture, and thus becomes into the second state, so that the contact between the latch part 6 and the projecting portion 3*b* is released. The release of the contact between the latch part 6 and the projecting portion 3*b* allows the movement of the movable contact 3 in the direction indicated by the arrow X. The timing at which the latch part 6 is caused to be the second state is when the spring 5 is compressed and a force is accumulated therein as illustrated in FIG. 15.

In the second embodiment as well, as a result of providing the first region 71 and the second region 72, the movable contact 3 is moved at high speed so that the duration of an arc is shortened within the range in which an arc may occur, and the movable contact 3 is decelerated immediately before the movable contact 3 hits the fixed contact 7 so that the movable contact 3 and the fixed contact 7 are protected.

Note that the switching of the latch part 6 from the first state to the second state and the switching thereof from the second state to the first state, that is, the change in the posture of the latch part 6 may be carried out on the basis of an electrical signal transmitted on the basis of the position of the movable part 2 or the angle of rotation of the motor 14, or may be carried out by a mechanical operation on the basis of the position of the movable part 2 or the like.

In addition, the configurations described in the first embodiment can be combined, and the configurations described in the second embodiment can be combined. For example, a switchgear may include both of the blocking member 64 illustrated in FIG. 6 and the through-hole 62*a* illustrated in FIG. 8, or a switchgear may include the through-passage 3*d* and the communicating hole 4*b* illustrated in FIG. 10 and the latch part 6 illustrated in FIG. 13.

The configurations presented in the embodiments above are examples of the present invention, and can be combined with other known technologies or can be partly omitted or modified without departing from the scope of the present invention.

REFERENCE SIGNS LIST

1, 51 switchgear; 2 movable part; 2*a* hole; 2*b* groove; 3 movable contact; 3*a* groove; 3*b* projecting portion; 3*c* end; 3*d* through-passage; 4 frame; 4*a* opening; 4*b* communicating hole; 5 spring; 6 latch part; 7 fixed contact; 7*a* contact point; 8 lever; 8*a* shaft; 8*b*, 9 pin; 11 first pulley; 12 second pulley; 13 wire mechanism; 13*a* flexible jacket; 13*b* wire; 14 motor; 15 first base; 16 second base; 31 second magnet; 61 first magnet; 62 metallic member; 62*a* through-hole; 63 sealing member; 64 blocking member; 65 arc; 71 first region; 72 second region.

The invention claimed is:

1. A switchgear comprising:

a movable part capable of reciprocating movement including movement in a first direction and movement in a second direction opposite to the first direction;

a movable contact coupled to the movable part on a side of the first direction, the movable contact being capable of reciprocating movement including movement in the first direction and movement in the second direction relative to the movable part;

a biasing member to bias the movable contact in the first direction relative to the movable part;

a latch part capable of switching between a first state in which movement of the movable contact in the first direction is restricted and a second state in which movement of the movable contact in the first direction is permitted;

an accommodating part to accommodate the movable part and the movable contact therein, the accommodating part having an opening through which one end side of the movable contact passes, the one end side being a side of the first direction;

a fixed contact provided outside of the accommodating part and on a side of the first direction with respect to the movable contact; and a moving part to move with the movable contact when the movable contact moves in the first direction, wherein the movable part and the movable contact move in the first direction from initial positions at which the movable contact is away from the fixed contact to closed positions at which the movable contact is in contact with the fixed contact, in a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the biasing member after the movement of the movable contact was restricted, the latch part is switched to the second state in which the movement of the movable contact in the first direction is permitted, the accommodating part contains a first region and a second region within a range of the movement of the moving part, the second region being on a side of the first direction with respect to the first region, and the second region has an inner diameter smaller than that of the first region.

2. The switchgear according to claim 1, wherein the latch part includes a first magnet fixed to an inside of the accommodating part, and a metallic member, the metallic member being attracted by the first magnet from a side of the first direction when the movable part and the movable contact are at the initial positions, the movable contact includes a second magnet to come into contact with a part of the metallic member avoiding the first magnet from a side of the second direction when the movement of the movable contact in the first direction is restricted by the latch part, and the metallic member is the moving part.

3. The switchgear according to claim 1, wherein the second region has a tapered shape with the inner diameter decreasing in the first direction.

4. The switchgear according to claim 1, further comprising a blocking member to block a gap between the opening and the movable contact.

5. The switchgear according to claim 1, wherein the moving part has a through-hole extending therethrough from a side of the first direction to a side of the second direction.

6. The switchgear according to claim 1, wherein the movable contact has a through-passage extending therethrough from an end thereof on a side of the first direction to a part thereof on a side of the second direction with respect to the moving part in the second state, and a communicating hole enabling communication between the inside and an outside of the accommodating part is formed through one of walls of the accommodating part at a boundary between the first region and the second region.

7. The switchgear according to claim 1, further comprising a driver to move the movable part.

* * * * *